United States Patent [19]

Redmond et al.

[11] Patent Number: 4,940,426

[45] Date of Patent: Jul. 10, 1990

[54] HIGH DENSITY WOVEN WIRE HARNESS ASSEMBLY

[75] Inventors: John P. Redmond, Mechanicsburg; Ray N. Shaak, Lebanon, both of Pa.

[73] Assignee: AMP Incorporated, Harrisburg, Pa.

[21] Appl. No.: 390,793

[22] Filed: Aug. 8, 1989

[51] Int. Cl.[5] ..... H01R 9/07

[52] U.S. Cl. ..... 439/495; 439/77; 439/493; 29/850; 174/117 F

[58] Field of Search ..... 439/67, 77, 65, 66, 439/492–499, 591; 29/825, 829, 831, 850, 853; 174/117 F, 117 FF, 117 M

[56] References Cited

U.S. PATENT DOCUMENTS

| | | | |
|---|---|---|---|
| 1,012,030 | 12/1911 | Underwood | 174/117 M |
| 4,470,195 | 9/1984 | Lang | 29/825 |
| 4,518,648 | 5/1985 | Miyata et al. | 439/591 |
| 4,616,717 | 10/1986 | Luetzow | 174/117 F |
| 4,651,163 | 3/1987 | Suteron et al. | 174/117 M |
| 4,741,107 | 5/1988 | Mondor, III | 439/417 |
| 4,755,422 | 7/1988 | Headrick et al. | 428/256 |

*Primary Examiner*—David Pirlot
*Attorney, Agent, or Firm*—William B. Noll

[57] ABSTRACT

A high density electrical connector assembly, and method of manufacturing same. More particularly, the invention covers an essentially flat, woven screen formed of a plurality of substantially parallel, electrically conductive wires forming the warp wires thereof, where such wires may be as small as 2 mils in diameter. Arranged essentially perpendicular thereto are plural, spaced apart, insulative woof filaments. To one major face of said flat, woven screen is applied a hot laminating film to encapsulate said wires, while to such other major face a comparable film is applied. However, for such other face, the encapsulating film is not coextensive with the screen length, but rather is spaced from the ends thereof so as to provide for connector contacts on each such wire. If desirable, the contacts may be plated.

The invention also contemplates means for electrically interconnecting the assembly hereof to a high density circuit pattern, such as found on a PC board.

11 Claims, 3 Drawing Sheets

HIGH DENSITY WOVEN WIRE HARNESS ASSEMBLY

FIELD OF INVENTION

The invention is directed to the field of electrical connectors, and particularly to a low-cost, high density harness assembly, that eliminates contact interface between cable and connector.

BACKGROUND OF INVENTION

This invention relates to high density connectors, which as used herein are connectors having adjacent electrical conductors at very low center line spacings, and to the method of manufacture. Typical harness assemblies, as known in the electrical connector industry, may comprise a flat ribbon cable of discrete wires having insulation thereabout to isolate each wire from an adjacent wire. Each end of each discrete wire is terminated to an electrical connector housing, such as by a procedure known as insulation displacement (I.D.), or by crimping to a metal contact positioned within such housing. In the former case, the I.D. connector includes a V-shaped notch with prongs which insert in the polymeric, insulation material to pierce the insulation of the conductors for electrical termination. This type of connector has been utilized mainly for extruded cable imbedded in polymeric material since the center-to-center spacing of the conductors in such a method and construction may be accurately fixed in a manner that the prongs of the connector spaced likewise reliably pierce the conductors.

With both crimping and I.D. terminating, the wire is individually terminated to a contact member. As a consequence of the physical mass of such contacts, and the need to isolate adjacent contacts, the spacings therebetween were rather broad. One approach to decrease such spacings was to stagger the rows of contacts into two or more rows. Even then the spacings could not be reduced to less than about 25 mils or 0.025 inches.

With the trend toward miniaturization, particularly the rather fine circuitry of PC boards, a centerline spacing of 25 mils by conventional techniques was unacceptable. To further complicate the situation there are inherent limitations on wire, i.e. conductor size. That is, as the need for centerline spacing decreases, there is a concurrent need to reduce the wire size or diameter. To satisfy the latter requirement woven wire mesh was devised as a way to fabricate a connector assembly. U.S. Pat. No. 4,741,707 to Mondor, III, teaches a woven structure for terminating a woven cable, such as by insulation displacement, to an IDC connector. Even with this arrangement, the limitations noted above persist.

U.S. Pat. No. 3,447,120 to Rask, et al. teaches a high-frequency transmission line formed by plural layers of flat woven cables. But again, limitations exist by virtue of the fact that termination of the wires is to individual pins. Another approach is taught in U.S. Pat. No. 3,736,366 to Wittenberg. The patent relates to a tape cable structure having several sets of twisted wire pairs, in parallel relationship, which are laminated so that the twist points are in a fixed phase relation with each other. Each such pair is then terminated to a terminal block. A further but early effort to develop a woven circuit device is taught in U.S. Pat. No. 3,371,250 to Ross, et al.

But, as with the later devices, the conductor wires are individually terminated.

The present invention, by a method and construction to be described hereinafter, avoids the inherent limitations imposed by individual wire termination, and hereby is able to achieve a very fine centerline spacing for conductor wires. Such method and construction will become apparent for the description which follows.

SUMMARY OF THE INVENTION

This invention is directed to a high density electrical connector assembly, and to the method of manufacturing same. More particularly, the invention covers a flat, woven screen formed of a plurality of parallel, electrically conductive wires forming the warp wires thereof, where such wires may be as small as 2 mils in diameter. Arranged essentially perpendicular thereto are plural, spaced apart, insulative woof filaments. To one major face of said flat, woven screen is applied a hot laminating film to encapsulate said wires, while to such other major face a comparable film is applied. However, for such other face, the encapsulating film is not coextensive with the screen length, but rather is spaced from the ends thereof so as to provide for connector contacts on each such wire. By the use of two (2) mil wire, it is possible to construct an electrical connector assembly having a centerline spacing of as little as five (5) mils.

The invention also contemplates means for electrically interconnecting the assembly hereof to a high density circuit pattern, such as found on a PC board.

DETAILED DESCRIPTION OF PREFERRED EMBODIMENT

Figure 1:
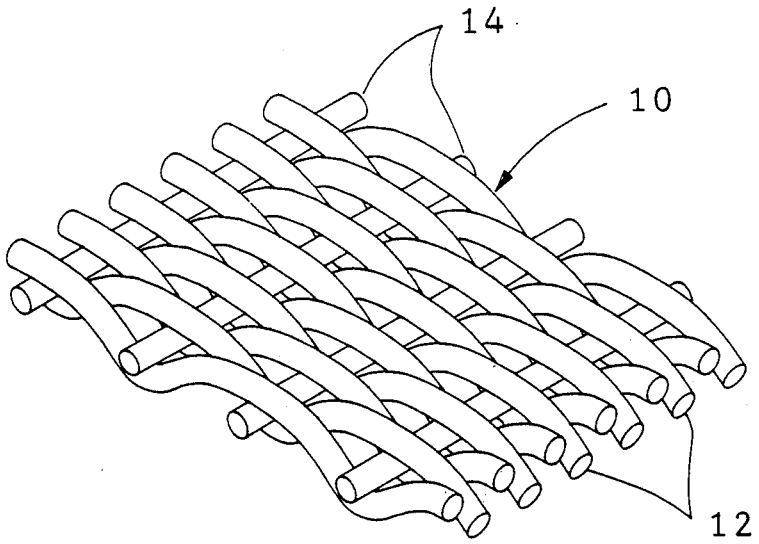
FIG. 1 is a perspective view of a high density, woven screen in a preliminary stage of the invention as hereinafter defined.

The present invention is directed to a high density, electrical connector assembly, and to the method of manufacturing such assembly. Such invention may best be understood by considering first the screen arrangement of FIG. 1. The screen 10 comprises a plurality of parallel, electrically conductive wires 12, which may be formed of a metal, or metal alloy, such as Cu, phosphor bronze, or Be-Cu. In the preferred embodiment hereof, the wire size may be about five (5) mils in diameter, or as little as two (2) mils. Perpendicular to such wires 12 are a plurality of spaced apart non-conductive filaments 14, such as a polyester, nylon or other plastic filament materials. While either the wires 12 or filaments 14 may be straight, with the other woven in an undulating fashion, it is preferred, for reasons to be apparent hereinafter, to weave the wires 12 to reveal a profile of alternating peaks and valleys. In any case, the screen arrangement of FIG. 1 represents the first step or product in the manufacturing process hereinafter described.

Figure 2:
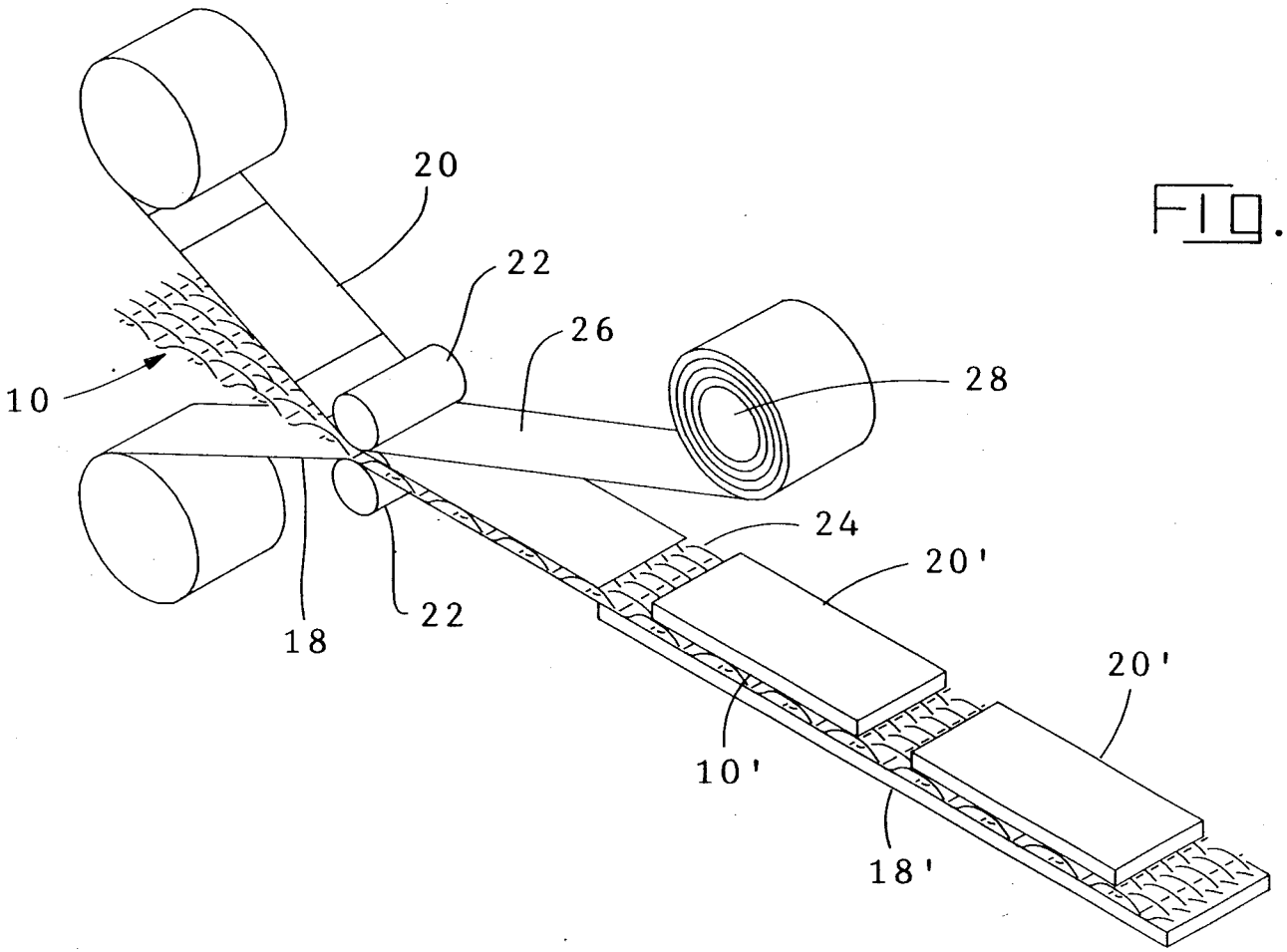
FIG. 2 is a schematic representation of the method of fabricating the electrical connector assembly of this invention.

In FIG. 2, a schematic representation is presented showing the inventive technique of fabricating the assembly of this invention. The woven screen 10, which may be fed continuously from a reel source, not shown, is fed between opposing plastic films 18, 20, which films have been provided with a heat activated adhesive on the major faces directed toward the screen 10. One film 18, by way of example, is continuous while the opposing film is pre-cut to discrete lengths, where such lengths are based on the final size of the assembly hereof.

With the respective films 18, 20 arranged adjacent screen 10, the composite is fed between a pair of heated nip rollers 22 to laminate the composite. By this operation, the adhesive of the film is caused to partially fill the voids between wires 12 and filaments 14 whereby to laminate the films thereto and insulate adjacent wires 12 from one another. It has been discovered that the lamination is more effective with the wires 12 woven, as opposed to the filaments 14.

Figure 3:
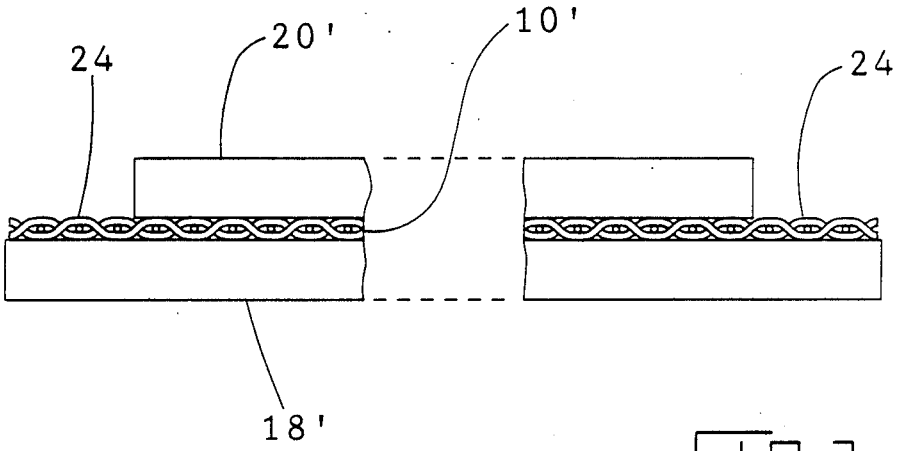
FIG. 3 is a perspective view of a high density, electrical connector assembly or harness produced by the fabrication technique of FIG. 2 according to this invention.

Since a feature of this invention is to provide a means of making electrical contact with the assembly hereof, one face of each end 24 of the laminated assembly is left exposed, i.e. without film and adhesive. One method of satisfying this requirement is the spaced apart placement of the film, having a predetermined length and spacing between films, onto a carrier strip 26. Under application of the heat of rollers 22, the film 20 is transferred to the screen 10 while the carrier strip 26 feeds continuously onto take-up reel 28. By this continuous operation, it is possible to produce a series of electrical connector assemblies characterized by a continuous screen 10', a first film 18' laminated to one side thereof, and a plurality of discrete film segments 20' laminated to the other side thereof. The continuous, laminated assembly may then be severed between the discrete segments to reveal an electrical connector assembly as shown in FIG. 3.

The exposed faces of ends 24 of the continuous laminated assembly, illustrated in FIG. 2, may be plated in a reel to reel fashion, in a manner known in the art. In the alternative, such assembly may be severed (FIG. 3) and such exposed wires plated as discrete parts. Typically gold or tin-lead is used as the plating metal for contacts.

As noted previously, the ends 24 are free of any film on one side and thus are exposed on such side. The exposed wires 12 constitute the electrical contacts for the harness as produced. Another feature hereof is the provision of a harness assembly that eliminates contact interface between the cable, i.e. wires 12, and a connector. That is, there are no intermediate discrete contacts, but rather direct electrical contact between the wires 12 and a PC board; see, for example, FIGS. 4 and 5.

Figure 4:
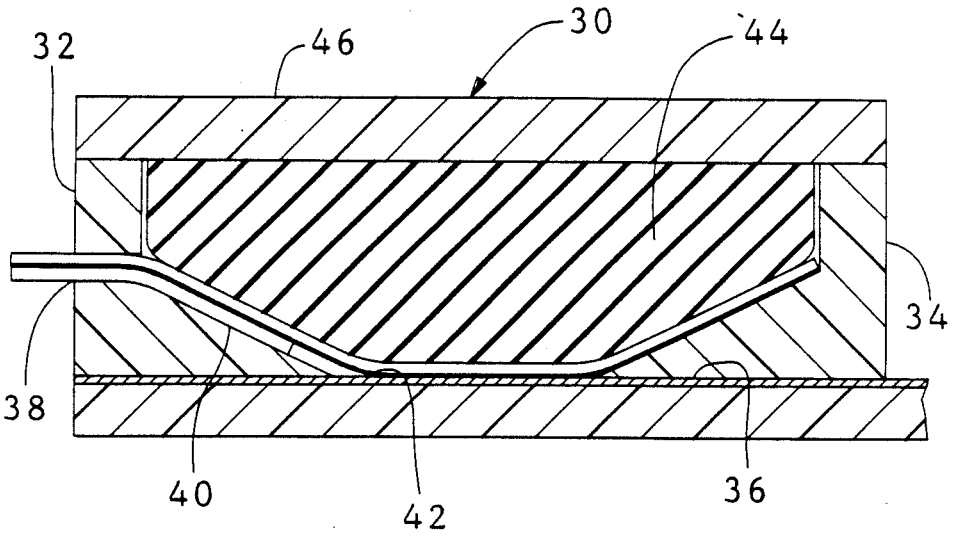
FIG. 4 is partial sectional view of a suitable connector assembly for electrically interconnecting the assembly hereof to a PC board.
Figure 5:
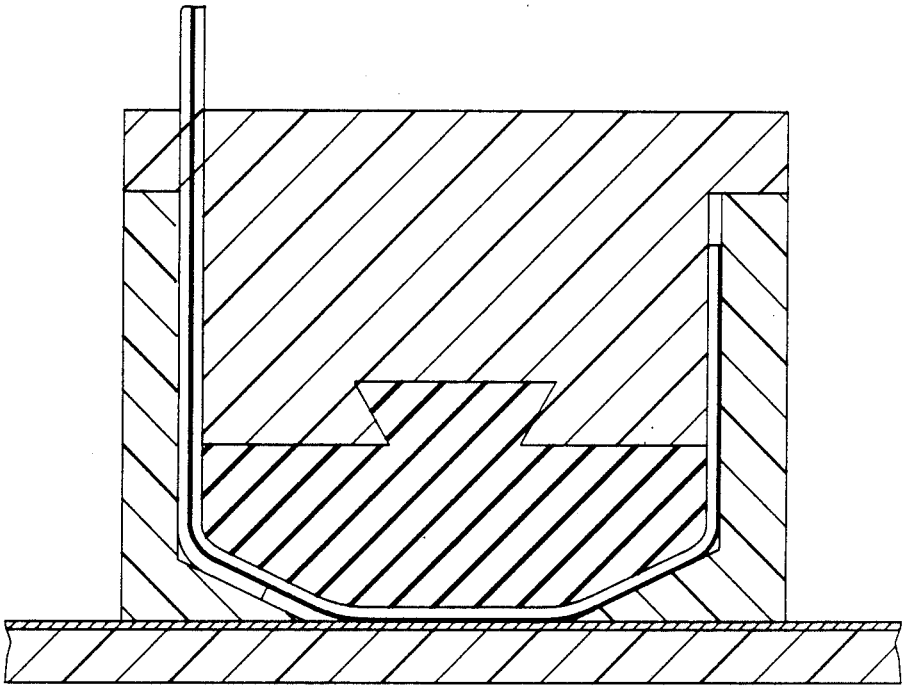
FIG. 5 is an alternative to the connector assembly shown in FIG. 4.

Such Figures represent two exemplary approaches to effect the use of the woven harness assembly of this invention in an electrical interconnection mode. FIG. 4 shows a housing 30 comprising side walls 32, 34 and base 36. Side wall 32 is provided with a slotted opening 38 for receiving the woven harness assembly illustrated in FIG. 3, which slotted opening also serves as a cable strain relief. The base 36 is sloped 40 to an opening 42 through which the exposed wires 12, essentially in a U-shaped configuration, may be brought into electrical contact with a connector, or PC board as illustrated in FIG. 4. A further element of such housing is the provision of a molded elastomeric member 44, bonded or joined to the cover 46. That is, such elastomeric member, such as a silicone rubber, may be bonded as the result of a dual injection molding process, or mechanically locked as illustrated in FIG. 5. When the cover 46 is mated to the body of the housing 30, the compressive force exerted by such cover is transferred uniformly to the "U" shaped wires by means of the elastomeric member 44. The cable wires are forced further into the opening 42 in the bottom of the housing to the point where they contact the pads on the PC board to provide an electrical path between the cable and the board.

By means not shown in FIG. 4, but well known in the art, the housing may be secured to the PC board. While FIG. 4 represents a side entry embodiment for the harness assembly, FIG. 5 shows a similar housing construction, but with a top entry. In each case, electrical contact is made by compressing the exposed and plated wires against the pads of a PC board. The compressive force arises from the manner of securing the housing to the boards, i.e. bolting, engaging tynes, clamping, etc. Additionally, as a result of such compressive force, the undulating wires, namely the series of peaks or valleys, as the case may be, provide excellent contact points with such pads. It is believed that such contact points readily penetrate any surface films that may be present on such pads.

SPECIFIC EMBODIMENT

By the practice of the method hereof, a high density, electrical connector assembly was constructed. The woven wire screen thereof consisted of about 200 copper wires, each wire having a diameter of about 5 mils, on a centerline spacing of 10 mils, and joined by nylon filaments at spaced intervals. From such materials as polyester, polyamide, and polyimide plastics, a 3 mil film of polyester was selected. Prior to applying such film to each side of the screen, an adhesive of Morthane, a thermoplastic urethane produced by Morton Thiokol Inc., was applied to one side of each film, to a thickness of about 5 mils.

A composite was fabricated, namely film-screen-film, by the application of heat and pressure. While the film on one side was the full length of the product, about twelve inches, the film on the opposite side was about eleven inches. That is, each end thereof had about ½ inch of screen exposed for subsequent plating of the copper wires. With such contact plating, as with gold, a high density, electrical connector assembly, or harness, was constructed to be secured in electrical contact, by a pair of housings shown in FIG. 4, to a PC board.

We claim:

1. A high density electrical connector assembly comprising a woven fabric formed of a plurality of parallel, electrically conductive wires of a discrete length forming the warp wires, where said warp wires have a small, uniform centerline spacing between adjacent warp wires, and a plurality of insulative woof filaments, an encapsulating film on one major flat side of said fabric to space and retain said parallel relationship, and a comparable encapsulating film on the opposite major face thereof, except that said conductive wires are exposed at the ends along a portion of the lengths to provide connector contacts, and a pair of end housings for electrically mating said exposed portions to a high density electrical circuit pattern.

2. The electrical connector assembly according to claim 1 wherein said warp wires are woven in an undulating fashion with said insulative woof filaments.

3. The electrical connector assembly according to claim 1 wherein each said housing comprises a pair of side walls, a sloped base having a central opening therein for exposing the connector contacts to said electrical circuit pattern, and a cover to urge said woven fabric against said electrical circuit pattern.

4. The electrical connector assembly according to claim 3 including an elastomeric joined to said cover and disposed between said cover and said connector contacts.

5. The electrical connector assembly according to claim 1 wherein said centerline spacing is no more than about ten (10) mils.

6. The electrical connector assembly according to claim 1 wherein said warp wires have a uniform diameter of from 2 to 5 mils.

7. A method of manufacturing a high density electrical connector assembly having multiple, parallel conductors with a uniform centerline spacing of no more than about ten (10) mils, where the ends of said conductors are adapted for engagement with end housings, said method comprising the steps of (a) selecting a woven fabric formed of a plurality of parallel, electrically conductive wires forming the warp wires, and a plurality of insulative woof filaments, (b) forming a composite therewith by placing on each side thereof a hot laminating film to encapsulate said wires, where one film is coextensive with the length of said wires and the opposing film is of a discrete length to form exposed ends on said conductors, and (c) applying end housings to the exposed ends of said conductors.

8. The method according to claim 7, including the step of applying a plating metal to said exposed wires between adjacent discrete lengths of said opposing film.

9. The method according to claim 7 wherein said insulative woof filaments are plastic.

10. The method according to claim 7 wherein the encapsulation is achieved by applying an adhesive to said films, followed by applying pressure thereto.

11. The method according to claim 8 wherein said one film is of an indeterminate length, including the step of severing the composite between adjacent lengths of said opposing film.

* * * * *

UNITED STATES PATENT OFFICE

CERTIFICATE OF CORRECTION

Patent No. 4,940,426 Dated July 10, 1990

Inventor(s) John Peter Redmond, Ray Ned Shaak

It is certified that error appears in the above-identified patent and that said Letters Patent is hereby corrected as shown below:

In claim 6, column 5, line 15, "claim 1" should be --claim 5--.

In claim 11, column 6, line 19, "claim 8" should be --claim 10--.

Signed and Sealed this

Eighteenth Day of February, 1992

*Attest:*

HARRY F. MANBECK, JR.

*Attesting Officer*

*Commissioner of Patents and Trademarks*